United States Patent [19]

Colton

[11] Patent Number: 4,474,373

[45] Date of Patent: Oct. 2, 1984

[54] PROVISION FOR GOALTENDER IN BASKETBALL

[76] Inventor: Roland J. Colton, 41 Vista Way, Port Washington, N.Y. 11050

[21] Appl. No.: 353,646

[22] Filed: Mar. 1, 1982

[51] Int. Cl.[3] ..... A63B 63/08

[52] U.S. Cl. ..... 273/1.5 R; 273/402

[58] Field of Search ..... 273/1.5, 398–402, 273/411, 407

[56] References Cited

U.S. PATENT DOCUMENTS

| | | | |
|---|---|---|---|
| 2,421,220 | 5/1947 | Robinson et al. | 273/1.5 R |
| 2,534,067 | 12/1950 | Rubin | 273/1.5 R |
| 3,802,703 | 4/1974 | Van Tassel | 273/1.5 R X |
| 3,958,806 | 5/1976 | Brown | 273/1.5 R X |
| 4,082,269 | 4/1978 | Hill | 273/1.5 R |
| 4,202,543 | 5/1980 | Collins | 273/1.5 R X |

FOREIGN PATENT DOCUMENTS

| | | | |
|---|---|---|---|
| 107913 | 7/1917 | United Kingdom | 273/407 |

OTHER PUBLICATIONS

Adams Plastics Inc., Circular 1-1980, Backboard Bumpers.

The Sporting Goods Dealer 2-1979, p. 132, PCA Industries Inc., Ad.

Parade Magazine, 7-1979, pp. 16 & 18, "Hocker".

*Primary Examiner*—Paul E. Shapiro

[57] ABSTRACT

Within the confines of a basketball court, a rigid and elevated structure supported upon a plurality of elements firmly affixed to the floor of the said court while supporting a bottomless basket of rectangular shape, a goaltenders' box adjacent to the said basket, a ladder acting as a stabilizing element while also providing access to the said box with an electrical circuit signal when a basketball falls through the said basket.

The structure may comprise angle iron, with the preferred materials being standard steel pipe assembled to produce a monolithic structure either by the use of standard pipe-railing fittings, or preferably by welding, with the dimensions of the bottomless basket being approximately 8 feet wide by 1 foot, or conforming to any revised rules of basketball.

3 Claims, 2 Drawing Figures

PROVISION FOR GOALTENDER IN BASKETBALL

My invention pertains to the game of basketball, and more particularly to lateral extension of the bottomless basket through which the basketball falls during the game, with provision for a goaltender to be stationed near the said basket.

The objective of my invention is to provide means whereby certain features of hockey and soccer may be added to the game of basketball in order to enhance the entertainment value of the game.

Persons versed in the arts to which my invention pertains may be enabled to make and use this device after reference to the drawings and specification wherein vertical elements are referred to as posts while horizontal elements are referred to as rails.

Figure 1:
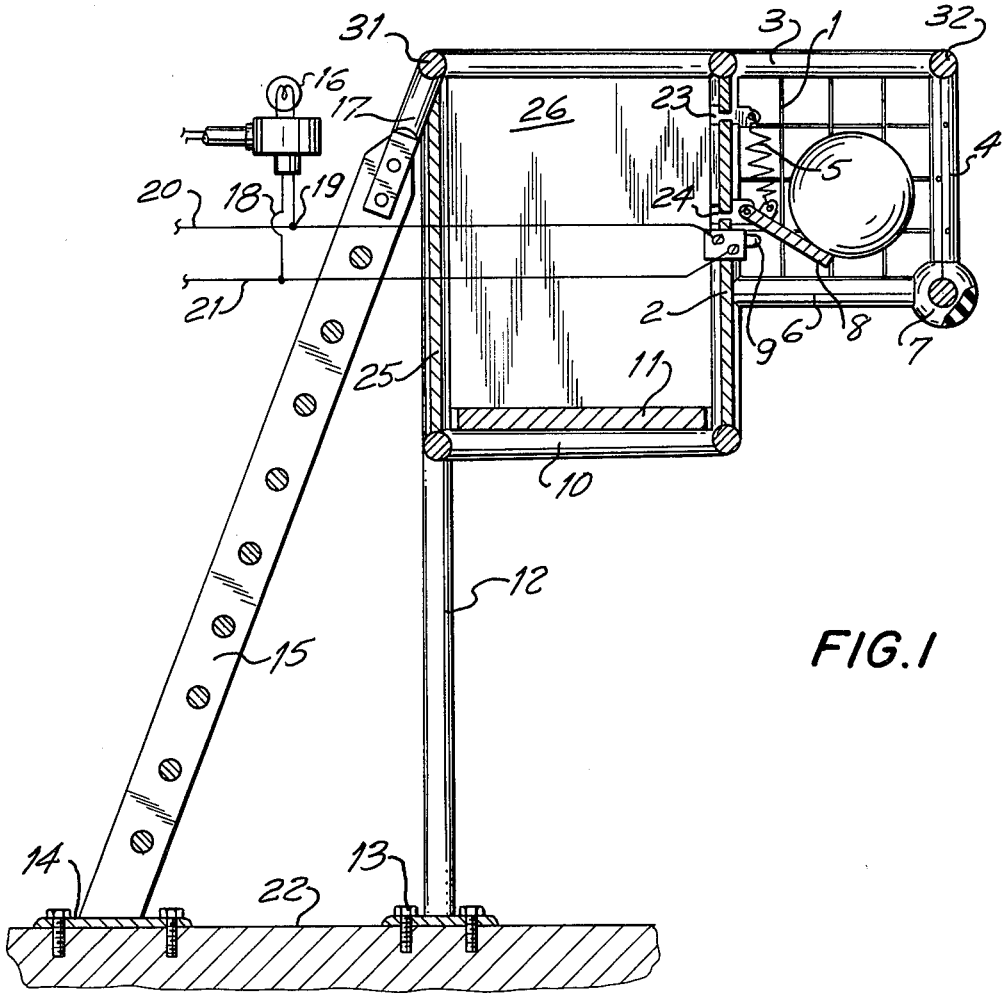
FIG. 1 is a sectional view of one of the identical sides of the complete structure embodying a goal-signal light indicated at 16, with a momentary contact switch indicated at 9.

FIG. 1 shows a basketball falling through the bottomless basket with one of the many strands of the said basket indicated at 1, which strands are firmly affixed to an upper rail indicated at 3, a post indicated at 4, and a lower rail indicated at 6. Sponge-rubber padding is indicated at 7, while a horizontally hinged gate is indicated at 8 and is shown in the act of yielding as a basketball falls through the said bottomless basket while causing elongation of the tension spring element indicated at 5 which spring is attached to the horizontally hinged gate and an anchor element indicated at 23, with this spring acting as a return spring in that it returns the said gate to a horizontal position after the basketball has fallen through the bottomless basket.

The sole function of the horizontal gate is to press a push button on a momentary contact switch indicated at 9, which action closes the said switch which is normally open and completes an electrical circuit through a goal-signal light indicated at 16. The pivoting action of the said gate is centered on the hinge element indicated at 33.

The left side of the goaltenders' box is indicated at 26 wherein the intervening space between two posts and two rails is closed by solid material such as plywood while the floor of the said box is indicated at 11, with a partition between the said box and the basket indicated at 24, while the back of the said box is indicated at 25.

The element indicated at 17 is a lug welded to the upper rear rail indicated at 31 wherein the goaltenders' ladder is firmly affixed and indicated at 15 while firmly affixed to the floor of the basketball court as indicated at 14, with the said floor indicated at 22.

Figure 2:
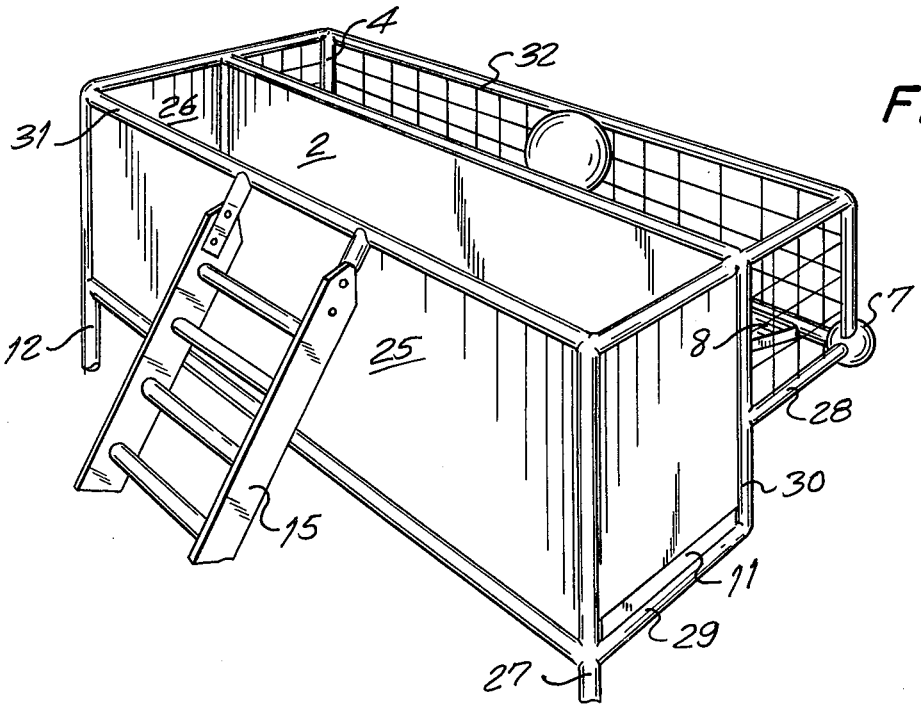
FIG. 2 is a perspective view of the structure with goal-signal light and parts of the supporting elements omitted.

The rail indicated at 10 supports the floor of the goaltenders' box indicated at 11 at one end, while an identical rail supports the opposite end of the said floor and is indicated at 29 in FIG. 2.

The element indicated at 12 is one of two vertical supporting posts affixed to the floor of the basketball court as indicated at FIG. 2. is shown in perspective with a vertical supporting element indicated at 27, a lower right side rail indicated at 29 while supporting the right end of the floor of the goaltenders' box indicated at 11. A short rail is indicated at 28, which rail is welded to the post indicated at 30, with the opposite end of the said rail terminating in a sperical element commonly known as a pipe-rail corner fitting.

The upper front rail is indicated at 32 with basket mesh attached to form one of three sides of basket while a partition between the goaltenders' box and the said basket forms the fourth side.

Here it may be seen that a basketball falling through the bottomless basket compels the horizontally hinged gate to push the pushbutton of the momentary contact switch thus completing an electrical circuit and causing a visible goal-signal.

Without departing from the spirit of my invention, the goal-signal may embody a smoke detector as used in factory smokestacks wherein a light beam is focussed on a photo electric cell with a visible signal at a remote position, while any materials found suitable may be embodied in the device, while padding may be attached to the structure to prevent injury to basketball players.

Having described my invention

1. Within the confines of a basketball court including a floor, a plurality of supporting elements firmly affixed to said floor, a goaltender's box secured in an elevated position above said floor on said support structure, a basket mounted in an elevated position adjacent said goaltender's box, one side of said goaltender's box forming a partition between said box and said basket, and a ladder extending between said floor and said box for access to said box by a goaltender.

2. The apparatus of claim 1, wherein said goaltender's box comprises an upper rail and said ladder is firmly affixed to said floor and said rail whereby said ladder acts as a stabilizing element holding said apparatus in a fixed position.

3. The apparatus according to either one of claims 1 or 2, and further comprising means to automatically display a signal whenever a basketball passes through said basket.

* * * * *